United States Patent [19]

Le Clercq

[11] 4,018,055

[45] Apr. 19, 1977

[54] STEEL CAISSONS

[76] Inventor: Pierre Alphonse Léon Marie Ghislain Le Clercq, 22, Avenue des Ormeaux, Brussels, Belgium

[22] Filed: Oct. 29, 1974

[21] Appl. No.: 518,959

[30] Foreign Application Priority Data

Oct. 26, 1973 Belgium ..... 806547
Oct. 18, 1974 Belgium ..... 149671

[52] U.S. Cl. ..... 61/53; 52/733; 52/740; 52/742

[51] Int. Cl.[2] ..... E04C 3/32; E04B 1/16; E02D 5/22

[58] Field of Search ..... 52/742, 169, 296, 297, 52/263, 249, 452, 730, 731, 725, 724, 423, 454, 733, 740; 61/53, 56

[56] References Cited

UNITED STATES PATENTS

| | | | |
|---|---|---|---|
| 139,415 | 5/1873 | Mulford | 52/334 |
| 1,068,541 | 7/1913 | Stewart | 52/452 |
| 1,073,542 | 9/1913 | Stewart | 52/336 |
| 1,090,171 | 3/1914 | Schisler | 52/731 |
| 1,120,108 | 12/1914 | Warwick | 52/249 |
| 1,858,512 | 5/1932 | Langenberg et al. | 52/725 |
| 1,924,346 | 8/1933 | Blumenthal | 61/53 |
| 1,951,292 | 3/1934 | Cahill | 61/53 |
| 2,198,985 | 4/1940 | Bailey | 61/53 |
| 2,355,947 | 8/1944 | Bondy et al. | 52/454 |
| 2,731,824 | 1/1956 | Hadley | 52/724 |
| 2,881,591 | 4/1959 | Reeve | 61/53 |
| 3,050,161 | 8/1962 | Shlager | 52/727 |
| 3,108,403 | 10/1963 | Jackson | 52/619.9 |
| 3,316,724 | 5/1967 | Tsuzuki | 61/56 |
| 3,385,015 | 5/1968 | Hadley | 52/334 |
| 3,401,497 | 9/1968 | Gregory et al. | 52/334 |

FOREIGN PATENTS OR APPLICATIONS

| | | | |
|---|---|---|---|
| 623,148 | 7/1961 | Italy | 52/404 |
| 4,045 | 2/1910 | United Kingdom | 61/60 |
| 745,329 | 2/1956 | United Kingdom | 52/724 |

*Primary Examiner*—Price C. Faw, Jr.
*Assistant Examiner*—James L. Ridgill, Jr.

[57] ABSTRACT

Steel caissons are assembled from steel components comprising plates or channel sections from which project a plurality of connecting means such as pins or bolts and on which are mounted reinforcing bars. The assembled caisson is a hollow steel beam of any desired cross-sectional shape and containing the reinforcements. Concrete is poured in situ into the hollow beam, which may also contain a sand-filled shaft.

6 Claims, 8 Drawing Figures

STEEL CAISSONS

BACKGROUND OF THE INVENTION

The invention relates to the construction of steel caissons for use in the construction of posts (columns) or piles comprising a number of steel components welded together and filled with concrete.

A main object of the invention is to construct the posts or piles, called "mixed steel-concrete posts or piles" from components which can be constructed at the factory by quick, inexpensive industrial methods and can be used to construct a sacrifice formwork for a reinforced concrete column or pile containing concrete which is placed in position on site.

The caissons can be either:

a. positioned in shafts formed in the ground, so as to serve as supports for basement and/or above-ground structures, or b. can be rammed into the ground and then filled with concrete, or c. can be simply used as columns.

The steel caissons according to the invention, which are made up of steel wall components which are assembled together, are characterized in that the components comprise projecting connecting means such as bolts for securing the concrete in known manner and in that reinforcing members for the concrete are secured to the connecting means, the caissons being manufactured at the factory together with the connecting means and concrete reinforcements or fittings, after which they are sent to the site.

BRIEF DESCRIPTION OF THE DRAWING

In order to show how the invention is put into practice, we shall now describe some non-limitative examples with reference to the accompanying drawings, in which.

DETAILED DESCRIPTION OF PREFERRED EMBODIMENT

Figure 1:
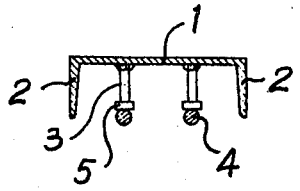
FIGS. 1 and 3 show two kinds of sectional components for constructing hollow caissons shown by way of example in FIGS. 2 and 4 respectively, which are views in horizontal section.
Figure 2:
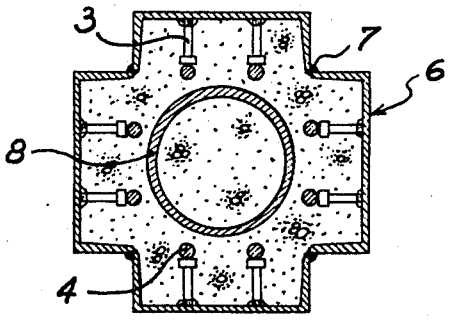
Figure 3:
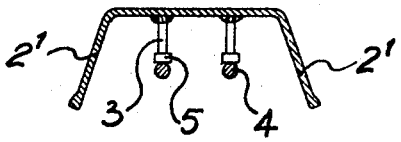
Figure 4:
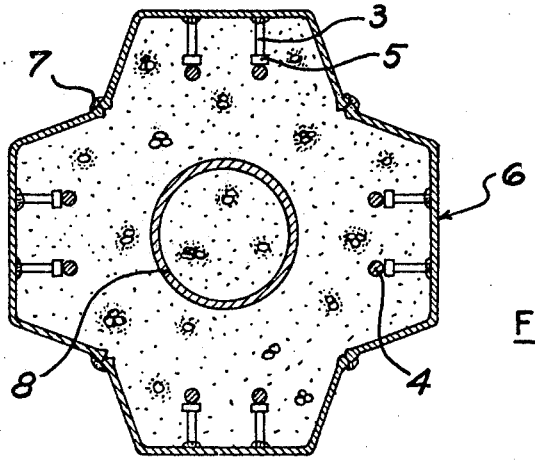

The metal post or pile is made up of a number of steel sectional components 1 which, in the case of FIGS. 1 and 2, have a U-shape comprising two parallel flanges 2 or two divergent flanges $2^1$ (FIGS. 3 and 4).

Cylindrical steel connecting bolts 3 are welded at one end, at positions chosen in dependence on the design of the final mixed steel-concrete column, perpendicular to the web of the U-sectional members; subsequently, round concrete reinforcements 4 are welded to the other end of bolts 3. Bolts 3 can have a head 5, which is likewise cylindrical and has a larger diameter, or may not have a head.

Sectional members 1 together with bolts 3 and concrete reinforcements 4 are subsequently assembled in groups of two, three or four components, to form a hollow caisson 6 (FIGS. 2 and 4). Caisson 6 is constructed by assembling together the aforementioned components, 1, 3 and 4, using longitudinal welding beads 7.

The dimensions of the caisson are chosen in dependence on the calculated loads to be borne by the final mixed steel-concrete post or pile. Usually, the dimensions are selected so that a concreting tube 8 can be inserted inside caisson 6 without being impeded by the concrete reinforcements 4 (FIGS. 2 and 4).

The steel caissons 6 are manufactured by the factory and subsequently sent to the site. They can easily be manipulated since they are light, because they are not yet filled with concrete.

Figure 5:
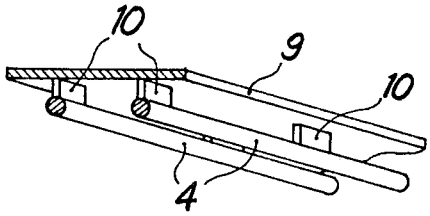
FIG. 5 is a perspective view of a variant embodiment of the sectional member.

Alternatively, the components to be assembled to form the caissons may be steel plates 9 (FIG. 5) provided with flat, square, round or other connecting components such as plates 10, which are welded to plate 9 and to which concrete reinforcements 4 are secured.

Figure 6:
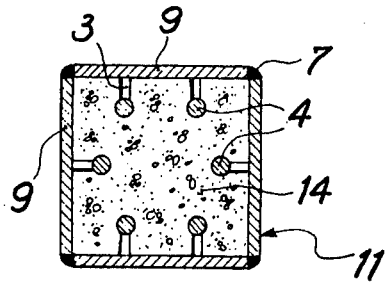
FIGS. 6, 7, 8 are sectional views of variant caissons.

FIG. 6 shows a caisson 11 having a square cross-section and made of flat components 9 interconnected by a weld bead 7 and provided with connecting components 3 to which concrete reinforcements 4 are secured.

Figure 7:
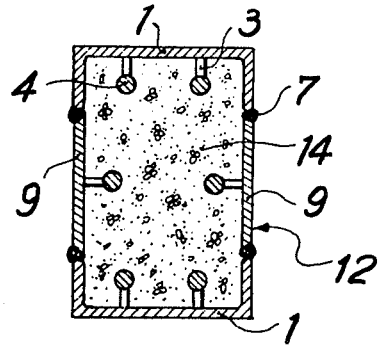

As FIG. 7 shows, caisson 12 can comprise flat components 9 and U-shaped iron members 1 connected by a weld bead 7. Alternatively, as shown in FIG. 8, caisson 13 can be made up of flat components 9 and U-shaped iron members having divergent flanges $2^1$.

Figure 8:
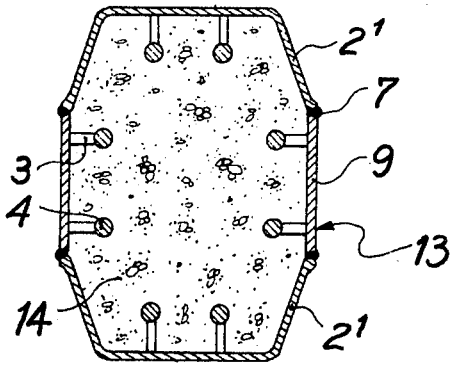

In FIGS. 6 – 8 the concrete is denoted by 14.

The caissons are suitable for working a building method whereby the storeys and basements of a building are simultaneously constructed, according to U.S. Pat. No. 3,457,690, wherein the caissons are positioned in shafts excavated in the ground, the base of the caissons being at a level below the bottom of the future excavation, whereupon the concrete is placed at the bottom of the shaft up to a level slightly below the bottom of the future excavation; subsequently gravel or sand is placed in the shaft, the caisson being filled with concrete at the same time as the shaft is filled with gravel or sand; after the concrete has hardened, the concrete-filled caisson is ready to withstand the weight of the superstructure and the basement structure and a column can be built on top of it.

I claim:

1. A prefabricated hollow metal caisson for a building structure and to be placed below ground level and filled with concrete, comprising: at least two prefabricated longitudinal metal wall components each being secured to adjacent components along the longitudinal outer side edges thereof to form a prefabricated hollow caisson, each wall component being provided with a plurality of longitudinally spaced projecting connecting means arranged along each wall component and extending inwardly and perpendicularly from the inner surfaces of the hollow caisson, said projecting connecting means terminating short of the central area of the caisson for providing an open area for admission of concrete into the caisson, and a plurality of longitudinal reinforceing members secured to the inner ends of said projecting connecting means and spaced from the central open area of said caisson.

2. A hollow metal caisson as claimed in claim 1 wherein said at least two longitudinal wall components have a substantially U-shaped cross section.

3. A hollow metal caisson as claimed in claim 1 wherein said longitudinal wall components comprise at least three flat metal plates.

4. A hollow metal caisson as claimed in claim 1 wherein said longitudinally spaced projecting connecting means comprise rectangular metal plates secured along one longitudinal edge to the inner surfaces of the hollow metal caisson and the longitudinal reinforcing members are secured to the opposed longitudinal edge thereof.

5. A hollow metal caisson as claimed in claim 1 wherein said projecting connecting means are bolt members welded at one end thereof to said wall components.

6. A hollow metal caisson as claimed in claim 5 wherein each bolt member is provided with an inner head portion and the longitudinal reinforcing members are welded to the head portions of said bolts.

* * * * *